US007594409B2

(12) United States Patent
Hayashi et al.

(10) Patent No.: US 7,594,409 B2
(45) Date of Patent: Sep. 29, 2009

(54) FREEZER APPARATUS

(75) Inventors: Koji Hayashi, Settsu (JP); Kenji Kinokami, Settsu (JP); Toshiyuki Momono, Settsu (JP)

(73) Assignee: Daikin Industries, Ltd., Osaka-shi, Osaka (JP)

( * ) Notice: Subject to any disclaimer, the term of this patent is extended or adjusted under 35 U.S.C. 154(b) by 576 days.

(21) Appl. No.: 10/560,241

(22) PCT Filed: Jun. 3, 2004

(86) PCT No.: PCT/JP2004/008071

§ 371 (c)(1),
(2), (4) Date: Dec. 12, 2005

(87) PCT Pub. No.: WO2004/111554

PCT Pub. Date: Dec. 23, 2004

(65) Prior Publication Data

US 2007/0006602 A1 Jan. 11, 2007

(30) Foreign Application Priority Data

Jun. 13, 2003 (JP) ..... 2003-169548

(51) Int. Cl.
*F25B 41/04* (2006.01)
*F25B 27/00* (2006.01)

(52) U.S. Cl. ..... 62/222; 62/238.6

(58) Field of Classification Search ..... 62/199, 62/200, 222, 223, 238.1, 238.6, 331
See application file for complete search history.

(56) References Cited

U.S. PATENT DOCUMENTS 3,916,638 A * 11/1975 Schmidt ..... 62/238.1
3,938,349 A * 2/1976 Ueno ..... 62/192

FOREIGN PATENT DOCUMENTS

| | | | |
|---|---|---|---|
| EP | 1624262 | A1 | 2/2006 |
| JP | 56-2140 | Y2 | 1/1981 |
| JP | 56-7955 | A | 1/1981 |
| JP | 4-165249 | A | 6/1992 |
| JP | 5-10567 | A | 1/1993 |
| JP | 5-22761 | Y2 | 6/1993 |
| JP | 8-114359 | A | 5/1996 |
| JP | 2002-372319 | A | 12/2002 |
| WO | WO-2004-102086 | A | 11/2004 |

* cited by examiner

*Primary Examiner*—Marc E Norman
(74) *Attorney, Agent, or Firm*—Birch, Stewart, Kolasch & Birch, LLP

(57) ABSTRACT

A refrigerator has a discharge three-way valve (8) for connecting the discharge side of a compressor (1) to at least either a hot water heat exchanger (3) or an air heat exchanger (6) and has a suction three-way valve (9) for connecting the suction side of the compressor (1) to at least either the air heat exchanger (6) or a cold water heat exchanger (4). In an operation primarily for cooling, a controller (19) regulates the opening of the discharge three-way valve (8) such that a refrigerant with a flow rate higher than a minimum flow rate (Qs) determined based on an outside air temperature flows to the air heat exchanger (6).

8 Claims, 2 Drawing Sheets

FREEZER APPARATUS

BACKGROUND OF THE INVENTION

The present invention relates to a refrigerator having liquid heat exchangers and an air heat exchanger.

Among refrigerator which simultaneously feed hot water and cold water has been a refrigerator which includes a compressor for compressing refrigerant, a hot water heat exchanger, an expander, a cold water heat exchanger, an air heat exchanger, a discharge three-way valve provided on discharge side of the compressor, and a suction three-way valve provided on suction side of the compressor (JP S56-7955 A).

In an operation primarily for cooling in which a thermal load on the cold water heat exchanger is larger than a thermal load on the hot water heat exchanger, the conventional refrigerator sets an opening of the discharge three-way valve so that discharge refrigerant is fed from the compressor to the hot water heat exchanger and the air heat exchanger at flow rates in a predetermined ratio and sets an opening of the suction three-way valve so that refrigerant is fed only from the cold water heat exchanger to the compressor. Thus the air heat exchanger functions as a condenser so that the thermal loads are balanced between the cold water heat exchanger with the comparatively large thermal load and the hot water heat exchanger with the comparatively small thermal load.

In an operation primarily for heating in which the thermal load on the hot water heat exchanger is larger than the thermal load on the cold water heat exchanger, on the other hand, the conventional refrigerator sets an opening of the discharge three-way valve so that discharge refrigerant from the compressor is fed only to the hot water heat exchanger and sets an opening of the suction three-way valve so that refrigerant is fed from the cold water heat exchanger and the air heat exchanger to the compressor at flow rates in a predetermined ratio. Thus the air heat exchanger functions as an evaporator so that the thermal loads are balanced between the hot water heat exchanger with the comparatively large thermal load and the cold water heat exchanger with the comparatively small thermal load.

The discharge three-way valve and the suction three-way valve are made of solenoid three-way valves, and openings of the valves are separately controlled by a controller. The controller detects the thermal loads on basis of an actual temperature of water that undergoes heat exchange in the cold water heat exchanger, an actual temperature of water that undergoes heat exchange in the hot water heat exchanger, and temperature differences between the actual temperatures and target temperatures, and the controller controls the openings of the discharge three-way valve and the suction three-way valve so as to balance the thermal loads.

When a condensing pressure of the refrigerant in the hot water heat exchanger is greatly larger than a condensing pressure of the refrigerant in the air heat exchanger in this type of refrigerator performing the operation primarily for cooling, so-called stagnation may occur in which the refrigerant stagnates in the air heat exchanger.

Therefore, it has conventionally been thought that the stagnation of the refrigerant can be prevented by control in which the controller sets the opening of the discharge three-way valve on the air heat exchanger side to be not smaller than 30% and not larger than 100%. That is, the control by which a minimum opening of the discharge three-way valve on the air heat exchanger side is set larger than the opening of 30% that prevents the stagnation of the refrigerant in the air heat exchanger is conceivable on an assumption that outside air where the air heat exchanger is positioned has a predetermined lowest temperature, that a target temperature of water from the hot water heat exchanger is set as a highest temperature, and that a largest pressure difference is thus caused between the condensing pressure in the hot water heat exchanger and the condensing pressure in the air heat exchanger.

The refrigerator, however, is supposed to control the opening of the discharge three-way valve on the hot water heat exchanger side within a range from 0% to 70% because the refrigerator controls the opening of the discharge three-way valve on the air heat exchanger side within a range from 30% to 100%. Therefore, a problem is caused in which it is difficult to accurately control temperature of water being heated by the hot water heat exchanger.

SUMMARY OF THE INVENTION

An object of the present invention is to provide a refrigerator that is capable of controlling temperature of the hot water heat exchanger with high accuracy without causing stagnation of refrigerant in the air heat exchanger.

In order to achieve the above object, a refrigerator of the present invention comprises:

a compressor for compressing refrigerant;

a first liquid heat exchanger performing heat exchange between the refrigerant and first liquid heat medium;

an expander expanding the refrigerant;

a second liquid heat exchanger performing heat exchange between the refrigerant and second liquid heat medium;

an air heat exchanger performing heat exchange between the refrigerant and air;

a refrigerant flow rate adjuster adjusting refrigerant flow rates in the first liquid heat exchanger, the second liquid heat exchanger and the air heat exchanger; and a controller controlling the refrigerant flow rate adjuster so that the refrigerant flows to the air heat exchanger at a flow rate not lower than a minimum flow rate which prevents stagnation of the refrigerant in the air heat exchanger in a situation where the refrigerant is made to flow to both the first liquid heat exchanger and the air heat exchanger.

According to the configuration, the refrigerant compressed in the compressor sequentially circulates through the first liquid heat exchanger, the expander and the second liquid heat exchanger with flow rates adjusted by the refrigerant flow rate adjuster. In this situation, the first liquid heat exchanger acts as a condenser to heat the first liquid heat medium, and the second liquid heat exchanger acts as an evaporator to cool the second liquid heat medium. On the other hand, a flow rate of the refrigerant to the air heat exchanger is adjusted by the refrigerant flow rate adjuster, and the air heat exchanger acts as a condenser or an evaporator. Thus a balance of thermal loads is adjusted between the first liquid heat exchanger and the second liquid heat exchanger.

The refrigerant flow rate adjuster is controlled by the controller so that the refrigerant flows to the air heat exchanger at a flow rate not lower than the minimum flow rate which prevents the stagnation of the refrigerant in the air heat exchanger in the situation where the refrigerant is made to flow to both the first liquid heat exchanger and the air heat exchanger.

Thus a necessary and sufficient amount of the refrigerant within a range preventing the refrigerant stagnation is fed to the air heat exchanger. Therefore, the first liquid heat exchanger to which the refrigerant is fed concurrently with the air heat exchanger is fed with the refrigerant with flow rate adjusted over a range wider than conventional ranges. As a result, the stagnation of the refrigerant in the air heat exchanger is prevented, and a temperature of the first liquid heat medium that undergoes heat exchange in the first liquid heat exchanger is adjusted more accurately than in conventional refrigerator.

In one embodiment, the controller controls the refrigerant flow rate adjuster so that the refrigerant flows to the air heat exchanger at a flow rate not lower than a minimum flow rate determined on basis of a temperature of outside air where the air heat exchanger is placed in a situation where the refrigerant is made to flow to both the first liquid heat exchanger and the air heat exchanger.

According to this embodiment, the refrigerant flow rate adjuster is controlled by the controller so that the refrigerant flows to the air heat exchanger at the flow rate not lower than the minimum flow rate determined on basis of the temperature of outside air where the air heat exchanger is placed in the situation where the refrigerant is made to flow to both the first liquid heat exchanger and the air heat exchanger. Therefore, the refrigerant is fed to the air heat exchanger at a necessary and sufficient flow rate in accordance with a condensing pressure in the air heat exchanger which pressure varies in accordance with the outside air temperature. When the outside air temperature is comparatively high, for example, a comparatively high condensing pressure in the air heat exchanger results in a comparatively low flow rate of the refrigerant that is fed to the air heat exchanger. Thus the flow rate of the refrigerant that is fed to the air heat exchanger is made smaller than the flow rate in the conventional refrigerator in which the minimum value of the valve opening is fixed at 30% in accordance with the predetermined low outside air temperature. That is, the refrigerant can be fed to the air heat exchanger at a flow rate of necessity minimum in accordance with the outside air temperature. Accordingly, the refrigerant with flow rates adjusted over a range wider than a conventional range is fed to the first liquid heat exchanger to which the refrigerant is fed concurrently with the air heat exchanger, and thus the temperature of the first liquid heat medium that undergoes heat exchange in the first liquid heat exchanger is adjusted with an accuracy higher than a conventional accuracy. Besides, the stagnation of the refrigerant in the air heat exchanger is effectively prevented.

In one embodiment, the controller controls the refrigerant flow rate adjuster so that the refrigerant flows to the air heat exchanger at a flow rate not lower than a minimum flow rate determined on basis of a temperature of outside air where the air heat exchanger is placed and a target temperature of the first liquid heat medium that undergoes heat exchange with the refrigerant in the first liquid heat exchanger, in a situation where the refrigerant is made to flow to both the first liquid heat exchanger and the air heat exchanger.

According to the embodiment, the refrigerant flow rate adjuster is controlled by the controller so that the refrigerant flows to the air heat exchanger at the flow rate not lower than the minimum flow rate determined on basis of the temperature of outside air where the air heat exchanger is placed and the target temperature of the first liquid heat medium that undergoes heat exchange with the refrigerant in the first liquid heat exchanger in the situation where the refrigerant is made to flow to both the first liquid heat exchanger and the air heat exchanger. That is, the minimum flow rate of the refrigerant that is made to flow to the air heat exchanger is determined on basis of the temperature of outside air where the air heat exchanger is placed and the target temperature of the first liquid heat medium in the first liquid heat exchanger in the situation where the refrigerant is made to flow to both the first liquid heat exchanger and the air heat exchanger. Thus the flow rate of the refrigerant that is fed to the air heat exchanger makes a flow rate corresponding to the condensing pressure of the air heat exchanger that varies in accordance with the outside air temperature, and the flow rate of the refrigerant that is fed to the first liquid heat exchanger makes a flow rate that is required for setting the first liquid heat medium to have the target temperature. Accordingly, the stagnation of the refrigerant in the air heat exchanger is prevented and the temperature of the first liquid heat medium can be adjusted by the first liquid heat exchanger with a higher accuracy.

In one embodiment, the controller controls the refrigerant flow rate adjuster so that the refrigerant flows to the air heat exchanger at a flow rate not lower than a minimum flow rate determined on basis of a temperature of outside air where the air heat exchanger is placed, a target temperature of the first liquid heat medium that undergoes heat exchange with the refrigerant in the first liquid heat exchanger, and a temperature of the first liquid heat medium that has undergone the heat exchange with the refrigerant in the first liquid heat exchanger, in a situation where the refrigerant is made to flow to both the first liquid heat exchanger and the air heat exchanger.

According to the embodiment, the refrigerant flow rate adjuster is controlled by the controller so that the refrigerant flows to the air heat exchanger at the flow rate not lower than the minimum flow rate determined on basis of the temperature of outside air where the air heat exchanger is placed, the target temperature of the first liquid heat medium that undergoes heat exchange with the refrigerant in the first liquid heat exchanger, and the temperature of the first liquid heat medium that has undergone the heat exchange with the refrigerant in the first liquid heat exchanger, in the situation where the refrigerant is made to flow to both the first liquid heat exchanger and the air heat exchanger. That is, the minimum flow rate of the refrigerant that is made to flow to the air heat exchanger is determined on basis of the temperature of outside air where the air heat exchanger is placed, the target temperature of the first liquid heat medium that undergoes heat exchange with the refrigerant in the first liquid heat exchanger, and the temperature of the first liquid heat medium that has undergone the heat exchange with the refrigerant in the first liquid heat exchanger. Thus the flow rate of the refrigerant that is fed to the air heat exchanger makes a flow rate corresponding to the condensing pressure of the air heat exchanger that varies in accordance with the outside air temperature. The flow rate of the refrigerant that is fed to the first liquid heat exchanger makes a flow rate corresponding to a load that is determined from the target temperature of the first liquid heat medium and the actual temperature of the first liquid heat medium. Accordingly, the stagnation of the refrigerant in the air heat exchanger is prevented and the temperature of the first liquid heat medium can be adjusted by the first liquid heat exchanger with a higher accuracy.

In any of the refrigerator, the refrigerant flow rate adjuster may be formed of a three-way valve or may be formed of a combination of a plurality of two-way valves.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
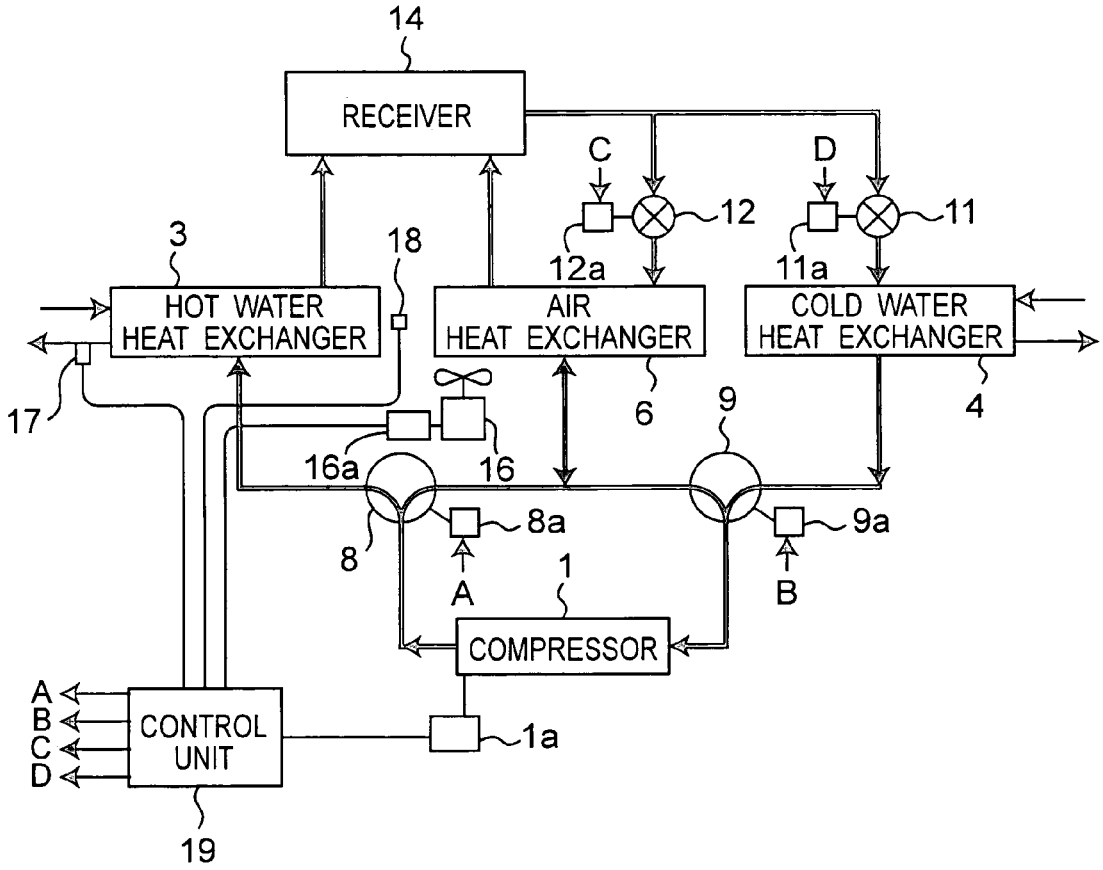
FIG. 1 is a schematic diagram showing a refrigerator in accordance with an embodiment of the invention.

Hereinbelow, the invention will be described in detail with reference to embodiments shown in the drawings.

FIG. 1 is a schematic diagram showing a refrigerator in accordance with an embodiment of the invention.

The refrigerator simultaneously feeds cold water and hot water, and has a compressor 1 for compressing refrigerant, a hot water heat exchanger 3 as a first liquid heat exchanger, a cold water heat exchanger 4 as a second liquid heat exchanger, and an air heat exchanger 6. As the refrigerant, for example, HFC (hydrofluorocarbon) refrigerant such as R407C is used.

A discharge three-way valve 8 is connected to a discharge pipe of the compressor 1 and an opening of the discharge three-way valve 8 is changed so that high-pressure refrigerant from the compressor 1 is fed into the hot water heat exchanger 3 and the air heat exchanger 6 with ratio of flow rates changed. On the other hand, a suction three-way valve 9 is connected to a suction pipe of the compressor 1 and an opening of the suction three-way valve 9 is changed so that low-pressure refrigerant from the air heat exchanger 6 and low-pressure refrigerant from the cold water heat exchanger 4 are fed into the compressor 1 with ratio of flow rates changed. Both the discharge three-way valve 8 and the suction three-way valve 9 are made with use of solenoid three-way valves, and each of the valves functions as the refrigerant flow rate adjuster of the invention.

The hot water heat exchanger 3 carries out heat exchange between high-temperature high-pressure refrigerant from the compressor 1 and water as the first liquid heat medium and thus heats the water. The cold water heat exchanger 4 carries out heat exchange between low-temperature low-pressure refrigerant expanded by a first electronic expansion valve 11 as the expander and water as the second liquid heat medium and thus cools the water.

The air heat exchanger 6 acts as a condenser or an evaporator in accordance with the openings of the discharge three-way valve 8 and the suction three-way valve 9. When the air heat exchanger 6 acts as the condenser, part of high-temperature high-pressure refrigerant from the compressor 1 is fed through the discharge three-way valve 8 and heat exchange is effected between the refrigerant and air. The refrigerant having undergone heat exchange in the air heat exchanger 6 is led through refrigerant line where a check valve is interposed to a liquid receiver 14. When the air heat exchanger 6 acts as the evaporator, part of the refrigerant led from the hot water heat exchanger 3 to the liquid receiver 14 is expanded and decompressed by a second electronic expansion valve 12 as the expander. The expanded and decompressed refrigerant is led to the air heat exchanger 6 and heat exchange is effected between the refrigerant and air. The refrigerant having undergone heat exchange in the air heat exchanger 6 is sucked through the suction three-way valve 9 into the compressor 1.

The air heat exchanger 6 is subjected to air blow from a blower 16 and thus a condensing pressure of refrigerant inside the air heat exchanger 6 is adjusted. The blower 16 has a fan and a variable speed motor for driving the fan, and control over amount of air blow to the air heat exchanger 6 is effected by control over rotational speed of the variable speed motor.

The refrigerator has a controller 19 for controlling operation of the refrigerator in accordance with a target temperature Ts1 of water that is heated by the hot water heat exchanger 3 and a target temperature Ts2 of water that is cooled by the cold water heat exchanger 4. The controller 19 is connected to a hot water temperature sensor 17 for detecting a temperature Tm1 of water that comes out of the hot water heat exchanger 3, to a cold water temperature sensor for detecting a temperature Tm2 of water that comes out of the cold water heat exchanger 4, and to an outside air temperature sensor 18 for detecting a temperature To of outside air in which the air heat exchanger 6 is placed. On basis of signals from the sensors, the controller 19 controls the opening of the discharge three-way valve 8, the opening of the suction three-way valve 9, an opening of the first electronic expansion valve 11, and an opening of the second electronic expansion valve 12.

That is, each of the discharge three-way valve 8 and the suction three-way valve 9 has a housing having three ports, a valve disc that is accommodated in the housing and that provides communication between two or all of the three ports, and a solenoid or a motor for driving the valve disc. The solenoids or the motors are supplied with driving power by drivers 8*a* and 9*a*. On basis of signals from the controller 19, the drivers 8*a* and 9*a* change the power that is supplied for the solenoids or the motors and control positions of the valve discs relative to the housings. Thus communication between the three ports, flow rates of fluid flowing between the ports communicating with one another, and the like are controlled.

Each of the first and second electronic expansion valves 11 and 12 has a needle valve, a fluid path that is formed between an inflow port and an outflow port and that accommodates the needle valve, and a solenoid that drives the needle valve to advance and retreat in an axial direction. The solenoids are supplied with driving power by drivers 11*a* and 12*a*. On basis of signals from the controller 19, the drivers 11*a* and 12*a* change the power that is supplied for the solenoids and control positions of the needle valves relative to the fluid paths. Thus a distance between an outer circumferential surface of the needle valve and an inner circumferential surface of the fluid path is changed and a difference in pressure of fluid between the inflow port and the outflow port is controlled.

The controller 19 is also connected to an inverter 1*a* for supplying the compressor 1 with driving power, and a frequency of the power that is supplied for a motor of the compressor 1 from the inverter 1*a* is changed by control over an operating frequency of the inverter 1*a*. Thus a rotational speed of the motor of the compressor 1 is controlled, a rotational speed of a compressing element that is driven by the motor is controlled, and an amount of refrigerant that is discharged from the compressor 1 is controlled.

The controller 19 is also connected to an inverter 16*a* for supplying the blower 16 with driving power, and a frequency of the power that is supplied for the motor of the blower 16 from the inverter 16*a* is changed by control over an operating frequency of the inverter 16*a*. Thus a rotational speed of the motor of the blower 16 is controlled, a rotational speed of the fan of the blower 16 that is driven by the motor is controlled, and a volume of air that is delivered from the blower 16 to the air heat exchanger 6 is controlled. That is, the controller 19 acts also as blower controller.

The controller 19 carries out operations generally in five modes, in accordance with the target temperature and thermal load of the hot water heat exchanger 3 and the target temperature and thermal load of the cold water heat exchanger 4.

A first mode is a mode exclusive to cooling and an operation mode in which the target temperature Ts2 is set only for the cold water heat exchanger 4. In the mode, the opening of the discharge three-way valve 8 is set so that all the refrigerant discharged from the compressor 1 is fed to the air heat exchanger 6. The opening of the suction three-way valve 9 is set so that refrigerant only from the cold water heat exchanger 4 is fed to the compressor 1. Thus a refrigerant cycle is formed in which refrigerant circulates through the compressor 1, the air heat exchanger 6, the liquid receiver 14, the first electronic expansion valve 11, and the cold water heat exchanger 4, and only cooling of water is carried out in the cold water heat exchanger 4 with only the air heat exchanger 6 acting as the condenser.

A second mode is a mode primarily for cooling and an operation mode in which target temperatures are set for both the cold water heat exchanger 4 and the hot water heat exchanger 6 and in which the thermal load on the cold water heat exchanger 4 is larger than the thermal load on the hot water heat exchanger 6. In the mode, the opening of the discharge three-way valve 8 is set so that refrigerant discharged from the compressor 1 is introduced into the hot water heat exchanger 3 and the air heat exchanger 6 with a predetermined ratio. The opening of the suction three-way valve 9 is set so that only refrigerant from the cold water heat exchanger 4 is introduced into the compressor 1. Thus heating of water is carried out in the hot water heat exchanger 3 and cooling of water is carried out in the cold water heat exchanger 4 with both the hot water heat exchanger 3 and the air heat exchanger 6 acting as the condensers. The opening of the discharge three-way valve 8 is adjusted so that a balance between the thermal load on the hot water heat exchanger 3 and the thermal load on the cold water heat exchanger 4 is attained in the air heat exchanger 6.

A third mode is a cooling-heating equalized mode and an operation mode in which target temperatures are set for both the cold water heat exchanger 4 and the hot water heat exchanger 6 and in which the thermal load on the cold water heat exchanger 4 is generally as large as the thermal load on the hot water heat exchanger 6. In the mode, the opening of the discharge three-way valve 8 is set so that all the refrigerant discharged from the compressor 1 is fed to the hot water heat exchanger 3. The opening of the suction three-way valve 9 is set so that only refrigerant from the cold water heat exchanger 4 is introduced into the compressor 1. Thus a refrigerant cycle is formed in which refrigerant circulates through the compressor 1, the hot water heat exchanger 3, the liquid receiver 14, the first electronic expansion valve 11, and the cold water heat exchanger 4, and heating of water in the hot water heat exchanger 3 and cooling of water in the cold water heat exchanger 4 are carried out.

A fourth mode is a mode primarily for heating and an operation mode in which target temperatures are set for both the cold water heat exchanger 4 and the hot water heat exchanger 6 and in which the thermal load on the cold water heat exchanger 4 is smaller than the thermal load on the hot water heat exchanger 6. In the mode, the opening of the discharge three-way valve 8 is set so that all the refrigerant discharged from the compressor 1 is fed to the hot water heat exchanger 3. The opening of the suction three-way valve 9 is set so that refrigerant from the air heat exchanger 6 and refrigerant from the cold water heat exchanger 4 are introduced into the compressor 1 with a predetermined ratio. Thus both the cold water heat exchanger 4 and the air heat exchanger 6 act as the evaporators. The opening of the suction three-way valve 9 is adjusted so that the air heat exchanger 6 attains a balance between the thermal load on the hot water heat exchanger 3 and the thermal load on the cold water heat exchanger 4.

A fifth mode is a mode exclusive to heating and an operation mode in which a target temperature is set only for the hot water heat exchanger 3. In the mode, the opening of the discharge three-way valve 8 is set so that all the refrigerant discharged from the compressor 1 is fed to the hot water heat exchanger 3. The opening of the suction three-way valve 9 is set so that refrigerant is fed to the compressor 1 only from the air heat exchanger 6. Thus a refrigerant cycle is formed in which refrigerant circulates through the compressor 1, the hot water heat exchanger 3, the liquid receiver 14, the second electronic expansion valve 12, and the air heat exchanger 6, and only heating of water is carried out in the hot water heat exchanger 3 with only the air heat exchanger 6 acting as the evaporator.

Figure 2:
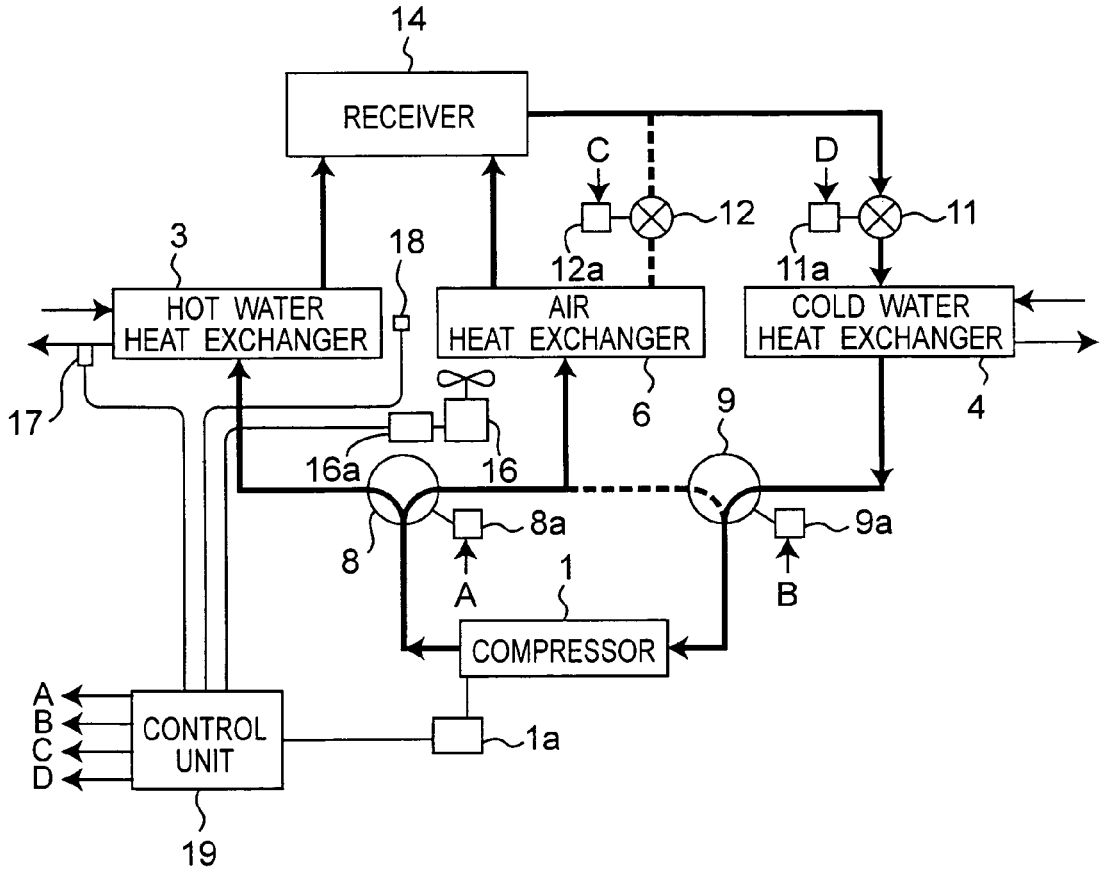
FIG. 2 is a diagram showing a refrigerant circuit that is formed in the refrigerator when a mode primarily for cooling is carried out.

FIG. 2 is a diagram showing a refrigerant circuit that is formed in the refrigerator when the controller 19 carries out the second mode, i.e., the mode primarily for cooling. In the mode primarily for cooling, the controller 19 calculates a minimum flow rate Qs of refrigerant to the air heat exchanger 6 on basis of an outside air temperature To detected by the outside air temperature sensor 18. The opening of the discharge three-way valve 8 is adjusted so that refrigerant flows to the air heat exchanger 6 at a flow rate which is not lower than the minimum flow rate Qs and which attains a balance between the thermal load on the hot water heat exchanger 3 and the thermal load on the cold water heat exchanger 4.

By the discharge three-way valve 8 adjusted with the specified opening, high-temperature high-pressure refrigerant discharged from the compressor 1 is separated and delivered into the hot water heat exchanger 3 and the air heat exchanger 6. The refrigerant introduced into the hot water heat exchanger 3 undergoes heat exchange with water introduced into the hot water heat exchanger 3 and heats the water, so that the temperature of the refrigerant falls. On the other hand, the refrigerant introduced into the air heat exchanger 6 with the specified flow rate undergoes heat exchange with air introduced by the fan 16 into the air heat exchanger 6 and the temperature of the refrigerant falls. The refrigerant from the hot water heat exchanger 3 and the refrigerant from the air heat exchanger 6 join at the liquid receiver 14. The refrigerant from the liquid receiver 14 undergoes adiabatic expansion in the first electronic expansion valve, takes on a low temperature and a low pressure, then cools water in the cold water heat exchanger to undergo temperature increase, and is sucked into the compressor 1.

The minimum flow rate Qs of refrigerant that is fed to the air heat exchanger 6 is determined in accordance with the outside air temperature To and therefore corresponds to the condensing pressure that varies in accordance with the outside air temperature To. Accordingly, the stagnation of refrigerant is effectively prevented in the air heat exchanger 6. When the outside air temperature To is comparatively high, for example, the minimum flow rate Qs that is calculated in accordance with the outside air temperature To can be set at a value smaller than a minimum flow rate from a conventional discharge three-way valve having a minimum opening fixed at 30%. Accordingly, refrigerant with flow rates adjusted over a range wider than a conventional range can be fed to the hot water heat exchanger 3 to which and the air heat exchanger 6 refrigerant is fed through the discharge three-way valve 8. As a result, a range of quantity of heat that is exchanged between water and refrigerant in the hot water heat exchanger 3 is wider than a conventional range, and thus the temperature of the water can be adjusted with an accuracy higher than a conventional accuracy.

By the refrigerator, an amount of refrigerant that is to be contained in the refrigerant circuit can greatly be reduced from a conventional amount because the refrigerator is capable of preventing the stagnation of refrigerant in the air heat exchanger 6. Besides, a problem is prevented in which influx into the compressor 1 of liquid refrigerant stagnated in the air heat exchanger 6 causes liquid compression and failure in the compressor 1 when the mode primarily for cooling is switched to the mode primarily for heating, because the stagnation of refrigerant in the air heat exchanger 6 can be prevented.

Though the controller 19 calculates the minimum flow rate Qs of refrigerant to the air heat exchanger 6 on basis of the outside air temperature To detected by the outside air temperature sensor 18 in the embodiment, the minimum flow rate Qs may be determined on basis of the target temperature Ts1 of the hot water heat exchanger 3 together with the outside air temperature To. Thus the minimum flow rate Qs of refrigerant that is fed to the air heat exchanger 6 makes a flow rate that fits the condensing pressure developed in the air heat exchanger 6 in accordance with the outside air temperature, and the flow rate of refrigerant that is fed to the hot water heat exchanger 3 makes a flow rate that is required for setting the water to have the target temperature Ts1. As a result, the stagnation of refrigerant in the air heat exchanger 6 can effectively be prevented. Besides, the temperature control by the hot water heat exchanger 3 can be performed more accurately than in conventional refrigerator.

The minimum flow rate Qs may be calculated on basis of the target temperature Ts1 of the hot water heat exchanger 3 and the hot water temperature Tm1 detected by the hot water temperature sensor 17, as well as the outside air temperature To. In this configuration, the opening of the three-way valve 8 is controlled with use of PID (proportional-plus-integral-plus-derivative) control based on the outside air temperature To, the target temperature Ts1, and the hot water temperature Tm1. Thus the minimum flow rate Qs of refrigerant that is fed to the air heat exchanger 6 makes a flow rate that fits the condensing pressure developed in the air heat exchanger 6 in accordance with the outside air temperature, and the flow rate of refrigerant that is fed to the hot water heat exchanger 3 makes a flow rate that corresponds to the load on the hot water heat exchanger 3. As a result, the stagnation of refrigerant in the air heat exchanger 6 can effectively be prevented and the temperature control by the hot water heat exchanger 3 can be performed more accurately.

In the embodiment, the discharge three-way valve 8 and the suction three-way valve 9 may be of any type as long as the valves have a function of making one port communicate with other two ports with openings varied. Alternatively, a plurality of selector valves or the like may be combined and used so as to serve the same function as the three-way valves have.

Though water is used as the first liquid heat medium and as the second liquid heat medium in the embodiment, brine such as ethylene-glycol-based liquid other than water may be used as one or both of the first liquid heat medium and as the second liquid heat medium.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A refrigerator comprising:

a compressor for compressing refrigerant;

a first liquid heat exchanger performing heat exchange between the refrigerant and first liquid heat medium;

an expander expanding the refrigerant;

a second liquid heat exchanger performing heat exchange between the refrigerant and second liquid heat medium;

an air heat exchanger performing heat exchange between the refrigerant and air;

a refrigerant flow rate adjuster adjusting refrigerant flow rates in the first liquid heat exchanger, the second liquid heat exchanger and the air heat exchanger; and a controller controlling the refrigerant flow rate adjuster so that the refrigerant flows to the air heat exchanger at a flow rate not lower than a minimum flow rate which prevents stagnation of the refrigerant in the air heat exchanger in a situation where the refrigerant is made to flow to both the first liquid heat exchanger and the air heat exchanger such that the first liquid heat exchanger and the air heat exchanger operate as condensers.

2. A refrigerator as claimed in claim 1, wherein the controller controls the refrigerant flow rate adjuster so that the refrigerant flows to the air heat exchanger at a flow rate not lower than a minimum flow rate determined on basis of a temperature of outside air where the air heat exchanger is placed in a situation where the refrigerant is made to flow to both the first liquid heat exchanger and the air heat exchanger.

3. A refrigerator as claimed in claim 1, wherein the controller controls the refrigerant flow rate adjuster so that the refrigerant flows to the air heat exchanger at a flow rate not lower than a minimum flow rate determined on basis of a temperature of outside air where the air heat exchanger is placed and a target temperature of the first liquid heat medium that undergoes heat exchange with the refrigerant in the first liquid heat exchanger, in a situation where the refrigerant is made to flow to both the first liquid heat exchanger and the air heat exchanger.

4. A refrigerator as claimed in claim 1, wherein the controller controls the refrigerant flow rate adjuster so that the refrigerant flows to the air heat exchanger at a flow rate not lower than a minimum flow rate determined on basis of a temperature of outside air where the air heat exchanger is placed, a target temperature of the first liquid heat medium that undergoes heat exchange with the refrigerant in the first liquid heat exchanger, and a temperature of the first liquid heat medium that has undergone the heat exchange with the refrigerant in the first liquid heat exchanger, in a situation where the refrigerant is made to flow to both the first liquid heat exchanger and the air heat exchanger.

5. A refrigerator as claimed in claim 1, wherein the first liquid heat exchanger and the air heat exchanger operate in parallel such that the first liquid heat exchanger and the air heat exchanger operate as condensers.

6. A refrigerator comprising:

a compressor for compressing refrigerant;

a first liquid heat exchanger performing heat exchange between the refrigerant and first liquid heat medium;

an expander expanding the refrigerant;

a second liquid heat exchanger performing heat exchange between the refrigerant and second liquid heat medium;

an air heat exchanger performing heat exchange between the refrigerant and air;

a refrigerant flow rate adjuster adjusting refrigerant flow rates in the first liquid heat exchanger, the second liquid heat exchanger and the air heat exchanger; and a controller controlling the refrigerant flow rate adjuster so that the refrigerant flows to the air heat exchanger at a flow rate not lower than a minimum flow rate which prevents stagnation of the refrigerant in the air heat exchanger on basis of a temperature of outside air where the air heat exchanger is placed in a situation where the refrigerant is made to flow to both the first liquid heat exchanger and the air heat exchanger.

7. A refrigerator as claimed in claim 6, wherein the controller controls the refrigerant flow rate adjuster so that the refrigerant flows to the air heat exchanger at a flow rate not lower than a minimum flow rate determined on basis of a temperature of outside air where the air heat exchanger is placed and a target temperature of the first liquid heat medium that undergoes heat exchange with the refrigerant in the first liquid heat exchanger, in a situation where the refrigerant is made to flow to both the first liquid heat exchanger and the air heat exchanger.

8. A refrigerator as claimed in claim 6, wherein the controller controls the refrigerant flow rate adjuster so that the refrigerant flows to the air heat exchanger at a flow rate not lower than a minimum flow rate determined on basis of a temperature of outside air where the air heat exchanger is placed, a target temperature of the first liquid heat medium that undergoes heat exchange with the refrigerant in the first liquid heat exchanger, and a temperature of the first liquid heat medium that has undergone the heat exchange with the refrigerant in the first liquid heat exchanger, in a situation where the refrigerant is made to flow to both the first liquid heat exchanger and the air heat exchanger.

* * * * *